US007200879B2

(12) United States Patent
Li et al.

(10) Patent No.: US 7,200,879 B2
(45) Date of Patent: Apr. 10, 2007

(54) WATERFALL WATERJET WITH DEBRIS REMOVING OUTLET

(75) Inventors: H. Charles Li, Peachtree City, GA (US); Robert D. Moore, Tyrone, GA (US)

(73) Assignee: Custom Molded Products LLC, Tyrone, GA (US)

( * ) Notice: Subject to any disclaimer, the term of this patent is extended or adjusted under 35 U.S.C. 154(b) by 371 days.

(21) Appl. No.: 10/899,945

(22) Filed: Jul. 27, 2004

(65) Prior Publication Data

US 2006/0021127 A1 Feb. 2, 2006

(51) Int. Cl.
*E04H 4/00* (2006.01)
*E03C 4/04* (2006.01)

(52) U.S. Cl. ..... 4/507; 4/678

(58) Field of Classification Search ..... 4/507, 4/509, 591, 678, 492, 541.1–541.6; 239/579, 239/590, 597

See application file for complete search history.

(56) References Cited

U.S. PATENT DOCUMENTS

| | | | |
|---|---|---|---|
| 4,852,190 | A | 8/1989 | Jacuzzi |
| 5,309,581 | A | 5/1994 | Lockwood |
| 5,893,179 | A | 4/1999 | Johnson |
| 6,170,094 | B1 | 1/2001 | Weise |
| 6,210,568 | B1 | 4/2001 | Harder |
| 6,367,100 | B2 | 4/2002 | Koren |
| 6,450,418 | B1 | 9/2002 | Simpson |
| 6,595,435 | B1 | 7/2003 | Cardenas |
| 6,595,675 | B2 | 7/2003 | Dongo |

OTHER PUBLICATIONS www.custom-molded-products.com online catalog of Assignee's products.

*Primary Examiner*—Gregory L. Huson
*Assistant Examiner*—Kristie A. Mahone
(74) *Attorney, Agent, or Firm*—Laurence P. Colton; Powell Goldstein LLP

(57) ABSTRACT

A waterfall waterjet that can be attached to a spa, with at least one chamber, at least one primary outlet, at least one debris outlet that can be opened and closed, and a water source fluidly connected to the waterfall waterjet.

53 Claims, 7 Drawing Sheets

FIG. 5
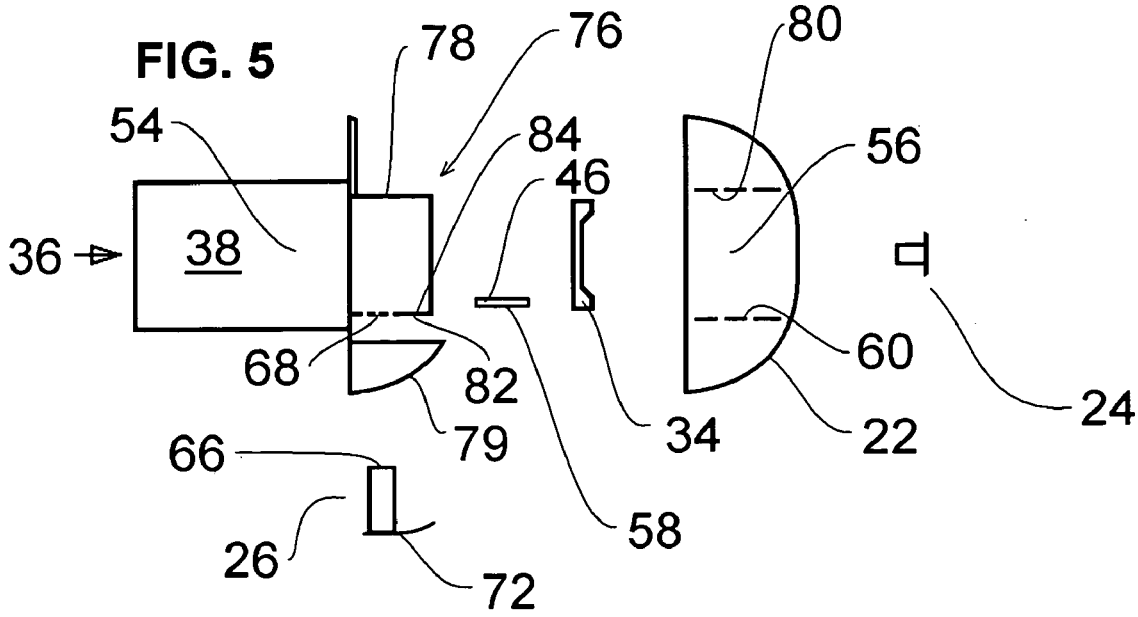
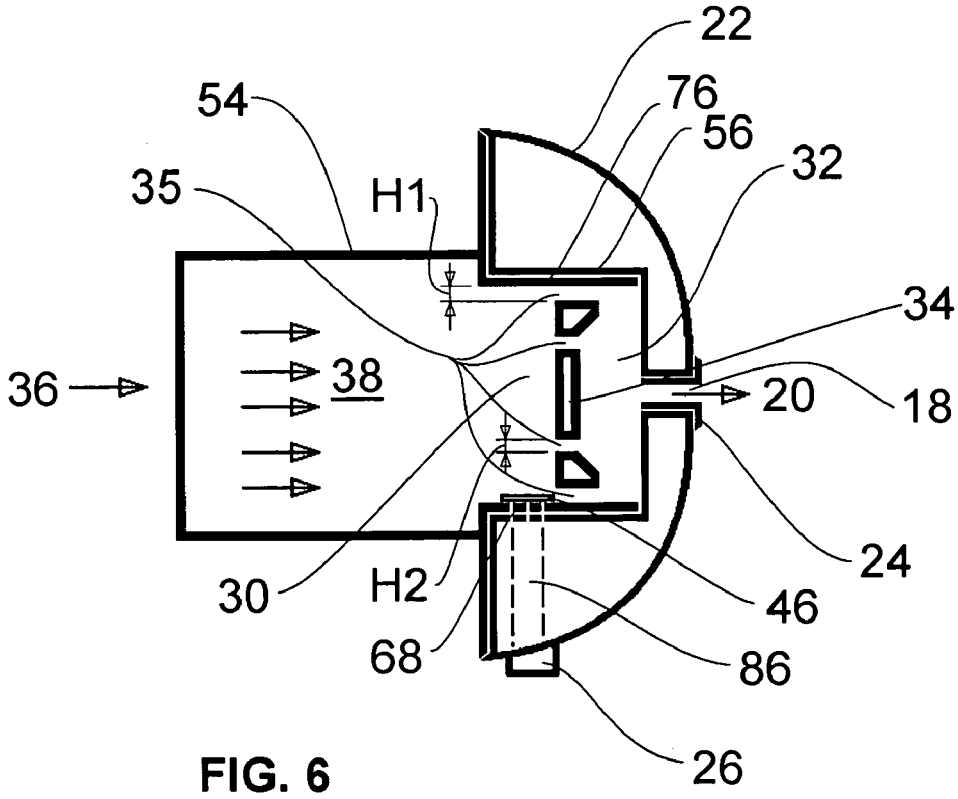
FIG. 6

WATERFALL WATERJET WITH DEBRIS REMOVING OUTLET

BACKGROUND OF THE INVENTION

1. Technical Field

The present invention generally is in the field of devices for generating waterfalls, and more particularly is in the field of devices for generating aesthetically pleasing waterfalls in spas, swimming pools, tubs and the like. The present invention further relates to a more cost efficient design and installation system for waterfall devices in spas, swimming pools, tubs, and the like, that include an alternate flowpath for the water through the device, or an alternate outlet for water from the device, so that debris and sediment trapped inside the device may be removed from the device.

2. Prior Art

Few applications derive more benefit from the addition of waterfalls or fountains than artificial bodies of water such as spas, swimming pools, and tubs. The popularity of waterfalls and fountains in such structures is probably associated with the numerous aesthetic and practical applications that make waterfalls desirable. More specifically, the addition of a waterfall or fountain to an artificial body of water can provide a substantial decorative effect or can provide a relaxing background sound, generated from the water flow. As such, users and owners of artificial bodies of water often desire the addition of waterfalls or fountains.

Many existing waterfall devices are generally custom-made for each particular artificial body of water. That is, such devices must be sized and configured to fit a specific water structure. Often, these waterfall devices must be integrated into the circulation and filtration system with additional materials, and they involve an array of plumbing and molding techniques. In some cases, such waterfall devices must have an independent filtering system and cleaning system so that the waterfall device does not become plugged with debris. As such, prior art waterfall devices tend to be relatively costly, difficult to install, and/or impossible to maintain.

A typical problem experienced by conventional waterfall devices is that debris and sediment become trapped. Such entrapment typically occurs in one of two fashions: (1) debris including small particles of wood, plastic, metal and other particles, often from the original installation or from the water source, become trapped behind the screens, baffles or other waterfall parts; or (2) when the water flow encounters obstructions in the flow, sediment falls out of the waterflow onto the bottom of the waterfall waterjet. This debris can build up inside and affect the operation of the waterfall device.

Accordingly, there is a need for a device that allows for the addition of a waterfall to an artificial body of water, such as a spa, swimming pool, tub or the like with a minimum of manufacturing and installation costs. There is also a need for such a device to be able to be integrated into a spa, swimming pool, tub or the like without excessively disrupting or interfering with the existing filtering system. There is a further need for a device that has a means for removing debris that may become trapped in the waterfall apparatus. It is to these needs and others that the present invention is directed.

BRIEF SUMMARY OF THE INVENTION

Briefly described, the present invention is a waterfall waterjet that produces a waterfall into a spa, swimming pool, tub, reservoir, or the like, and that incorporates an alternate flowpath for the water through the device, or an alternate outlet, so that debris trapped inside the device can be flushed out. The device also provides a means for filling such a reservoir with water. For simplicity, spas, swimming pools, tubs or the like, and all such reservoirs and artificial bodies of water, together or separately will be referred to as spas or a spa. The invention generally is a device that can be installed on the edge of a spa to provide for the addition of an aesthetically pleasing and decorative waterfall that flows into a spa. In the invention, water from a water source flows into the device and is discharged through a waterfall slot/primary outlet into the spa. Because the device can be placed above the surface of the water in the spa on the upper edge of the spa wall, the waterfall can be a smooth flow of falling water extending from the device to the surface of the water in the spa.

The waterfall waterjet of the present invention generally comprises an round inlet, a flow/outlet selector, baffles to remove turbulence and debris from the water, a primary outlet, and a debris-removing outlet. In its simplest form, the device may comprise a waterfall waterjet (including the inlet, outlet, and optional baffles/dividers) and a flow/outlet selector to choose between two or more flow paths/outlets. When the device is in the assembled condition, that is when the various components are installed in the spa, the device appears as a generally continuous shaped structure with the waterfall slot/primary outlet in the center of the waterfall waterjet.

In one embodiment, the device comprises a first chamber and a second chamber, separated by the baffles/dividers through which water flows. The baffles primarily remove turbulence from the water and secondarily can function as a screen to prevent debris from becoming lodged in other parts of the device or being ejected into the spa. The configuration of the baffles is variable, and they can have one or more distribution slots for allowing the passage of water between the first chamber and the second chamber. The first chamber preferably is a manifold structure intended for evenly distributing the water entering the device within the first chamber, and the second chamber preferably is structured for channeling the water through the primary outlet. Preferably, the baffles divide the interior of the device such that only the second chamber has direct access to the primary outlet. The baffles can be a single slot or a series of smaller slots or holes running approximately the length of the device. Further, the device will function even if there are no baffles, though it is likely that the waterfall will exhibit more turbulence.

The flow of water through the device occurs through regular fluid dynamics. The water may be recirculated as in most spa settings or the water may be provided from a separate water source such as a municipal water supply. Irrespective of the water source, the water flows through an inlet channel into the first chamber (typically elongated), past the baffles (if present), and into the second chamber, where the water passes out through the primary outlet into the spa.

The waterfall waterjet can be anchored to the wall or edge of a spa using any appropriate means as long as water is fed into, and water can flow out of, the device. More particularly, the device may be structured to have securing ends for securing the device to the spa wall. In this preferred embodiment, the device can be installed with a minimum of disturbance to the surrounding spa. It is further advantageous that the inlet and the attachment means are round so that a standard drill can be used to fix the device to the spa sidewall. Due to the configuration of the device with only the inlet and fastening means located on the dry side of the spa sidewall, potentially only a round inlet and preferably round fasteners require cuts to be made in the spa sidewall as opposed to typical waterfall devices which require complex cuts and accompanying high costs of installation. The present invention is therefore also much less costly to install than other waterfall devices.

In accordance with the present invention, the device can have at least two flowpaths/outlets, one of which may be dedicated to removing debris from the waterfall waterjet. In "normal" operation, the device produces an aesthetically pleasing waterfall. In contrast, when the device is in the "debris removing" operation, either the water's flow path through the device is changed such that debris can be carried out of the device, or an alternate outlet is opened that allows water to carry the debris and sediment out of the device.

The present invention includes one or more outlets whose purpose is to allow internally trapped debris to be removed without disassembling the device. Such outlets preferably are located proximal to the lateral ends of the first chamber. Debris frequently collects at these locations because of the tendency for low flow conditions. A preferred mechanism of opening such outlets includes a bar that can slide to open and close the debris outlets and a control lever that can move the bar. When the control lever is in a first position, the debris outlets are covered and there is no flow through them. When the control lever is in a second position, the debris outlets are opened, which permits flow therethrough. In operation and use, the present invention provides an aesthetically pleasant waterfall into a spa, a means for filling the spa with water, and the ability to remove trapped debris from the device.

The device is also capable of producing an illuminated waterfall when the device includes an optional light source. The light source can be either independent from or constructed integrally with the device in order to transmit as much light as possible to the waterfall. For example, the light source can be located on the means for attaching the device to the spa wall or within the device. Further, it is preferred that that at least a portion of the device is made of a transparent material.

The device can be used on almost any artificial water body. While the device is described in connection with a spa, it is understood that the device can be used on spas, swimming pools, tubs, and the like. For example, the device can be placed on the edge of a swimming pool so to provide a waterfall. One of ordinary skill in the art can modify the device without undue experimentation so that it can be placed on almost any artificial water body.

These features, and other features and advantages of the present invention will become more apparent to those of ordinary skill in the relevant art when the following detailed description of the preferred embodiments is read in conjunction with the appended drawings in which like reference numerals represent like components throughout the several views.

BRIEF DESCRIPTION OF THE DRAWINGS

FIG. 5 is an exploded side view of the invention.

FIG. 6 is a sectional side view of the invention.

DETAILED DESCRIPTION OF THE PREFERRED EMBODIMENTS

Figure 1:
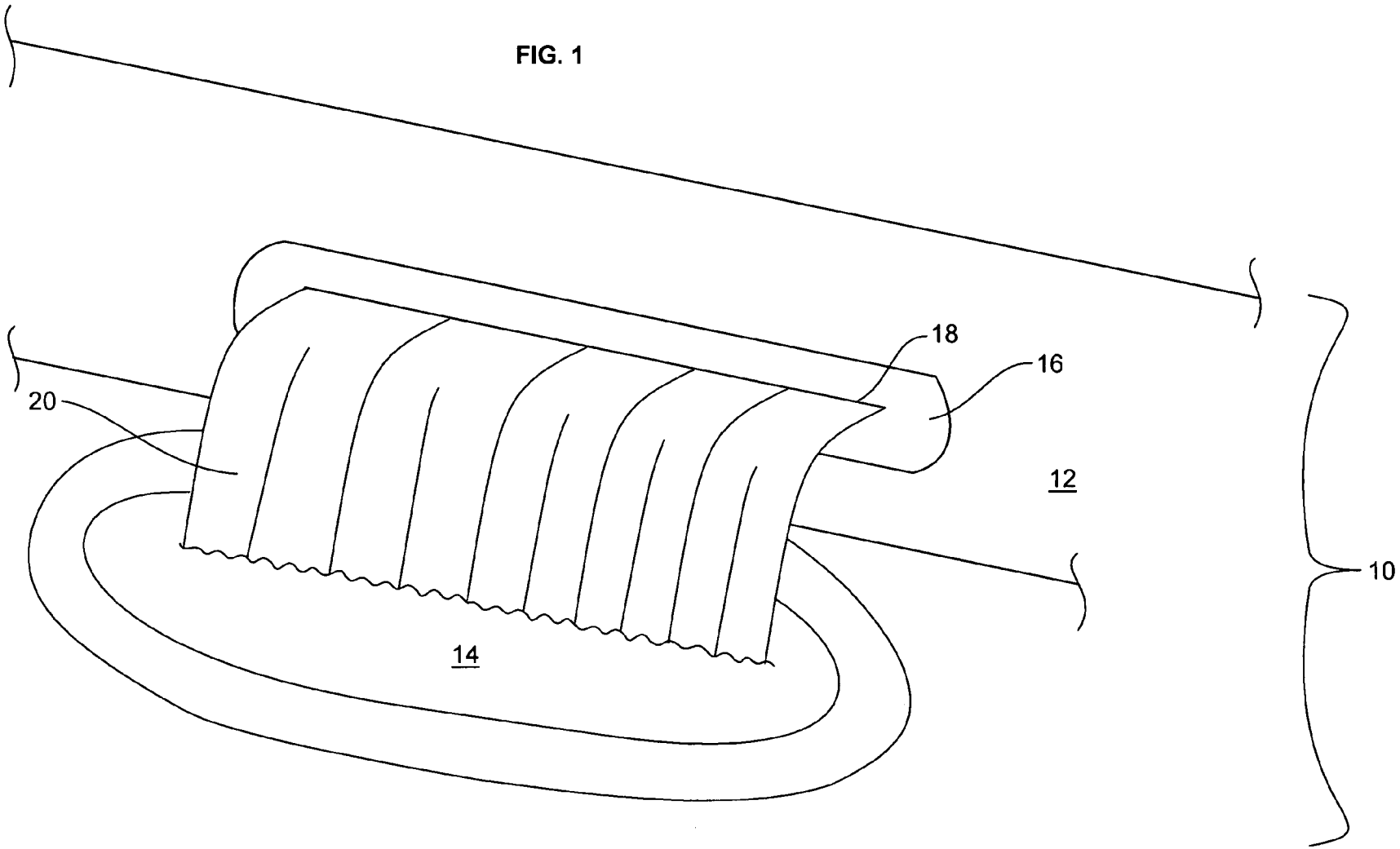
FIG. 1 is a perspective view of one embodiment of the present invention attached to a spa wall and producing a waterfall.
Figure 2:
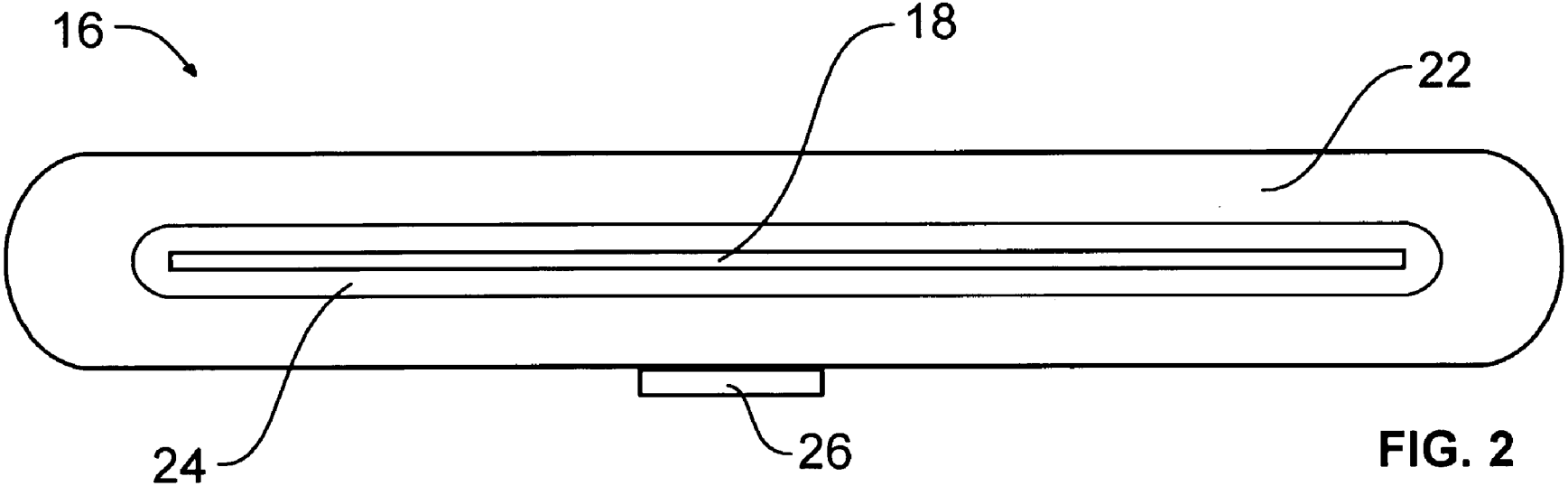
FIG. 2 is a front view of the embodiment shown in FIG. 1.
Figure 3A:
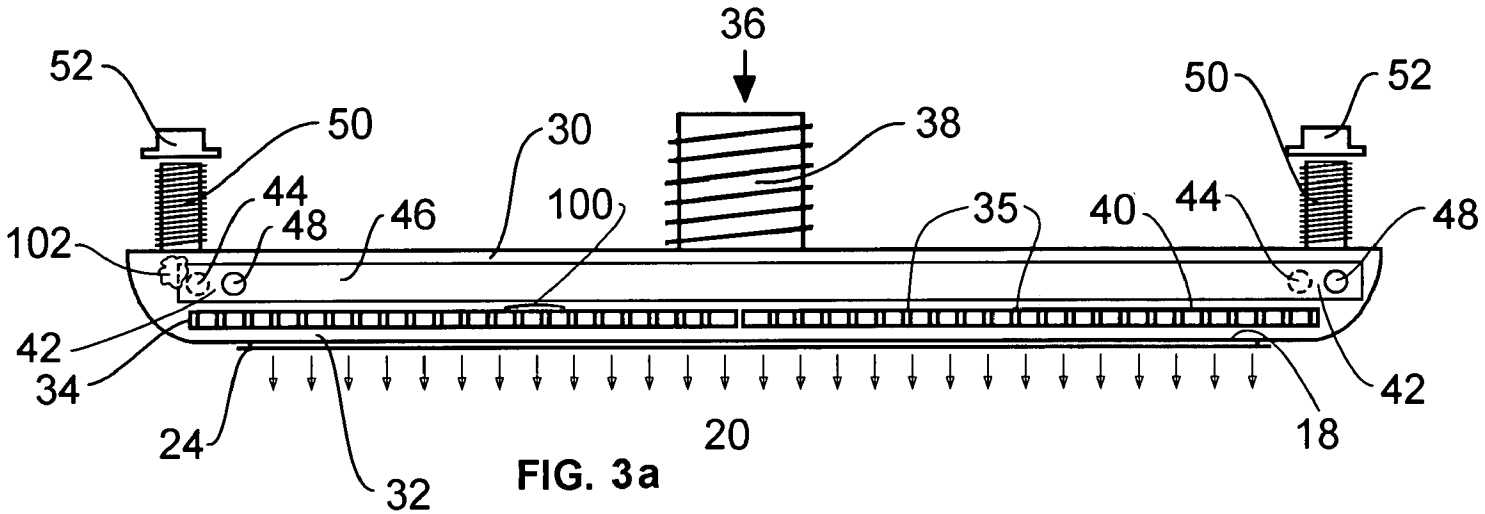
FIG. 3A is a sectional top view of the present invention.
Figure 3B:
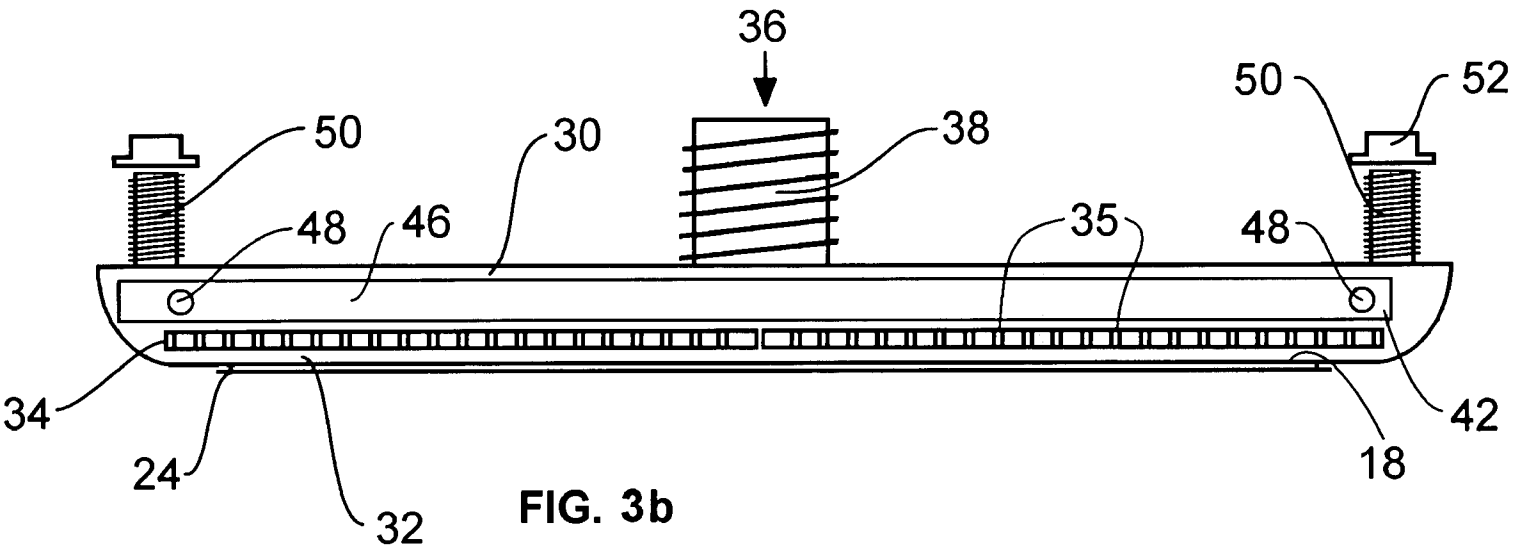
FIG. 3B is a sectional top view of the present invention.
Figure 4:
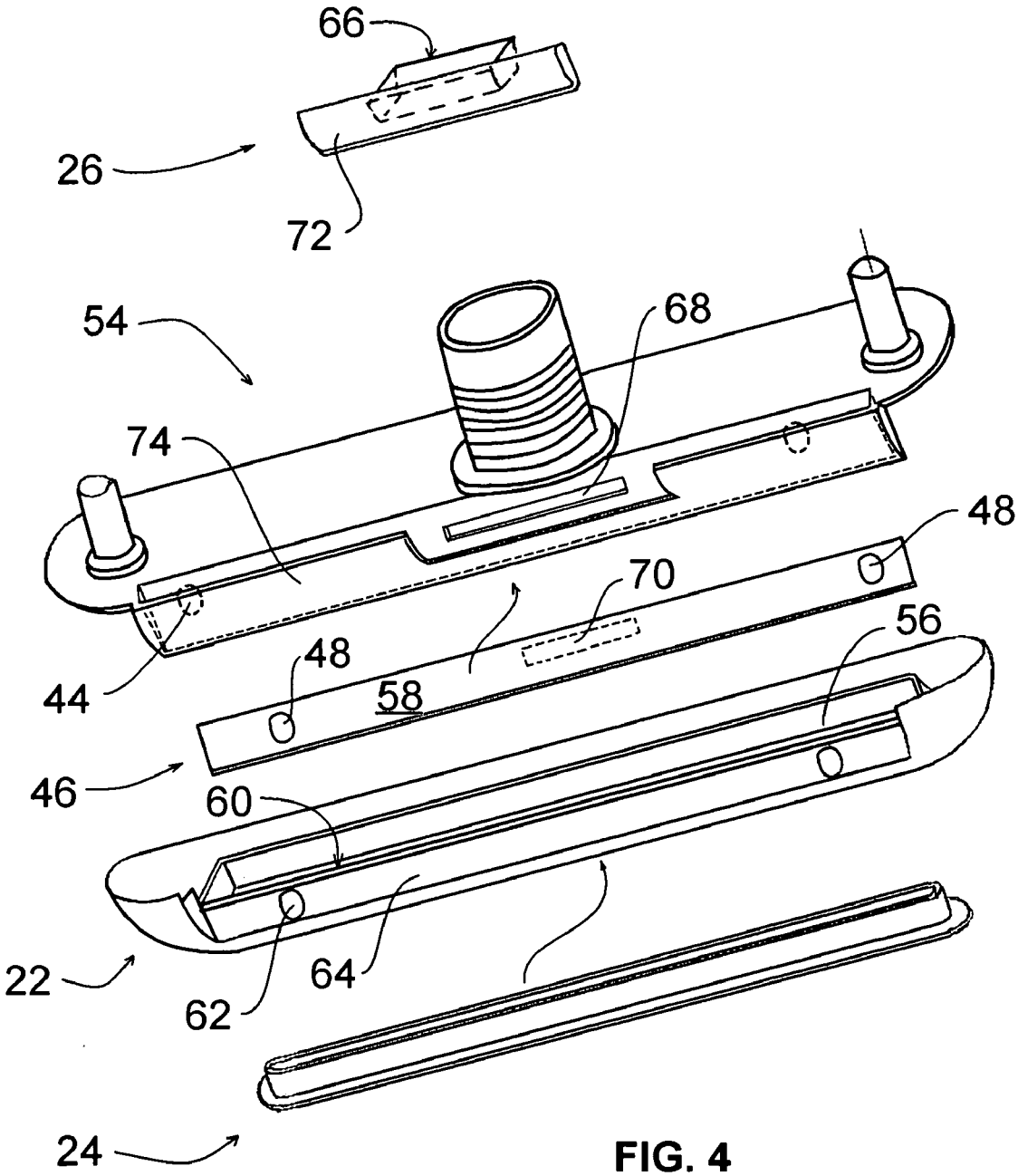
FIG. 4 is an exploded view of the embodiment shown in FIG. 1 showing the components of the waterfall waterjet.
Figure 7:
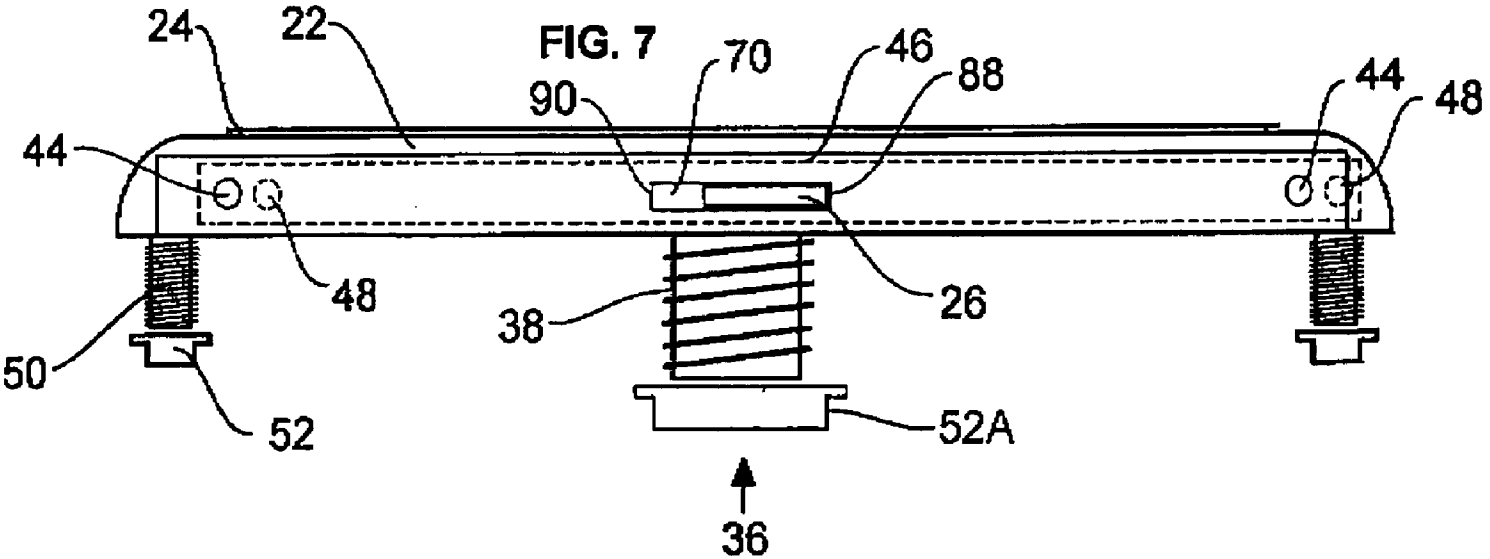
FIG. 7 is a bottom view of the invention.
Figure 8:
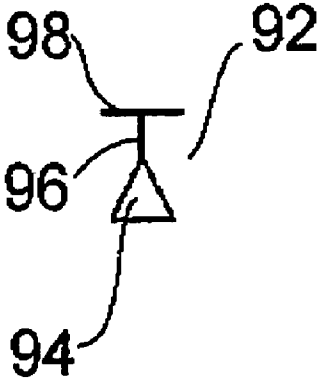
FIG. 8 is a view of an alternate method of closing the debris outlets of the present invention.
Figure 9:
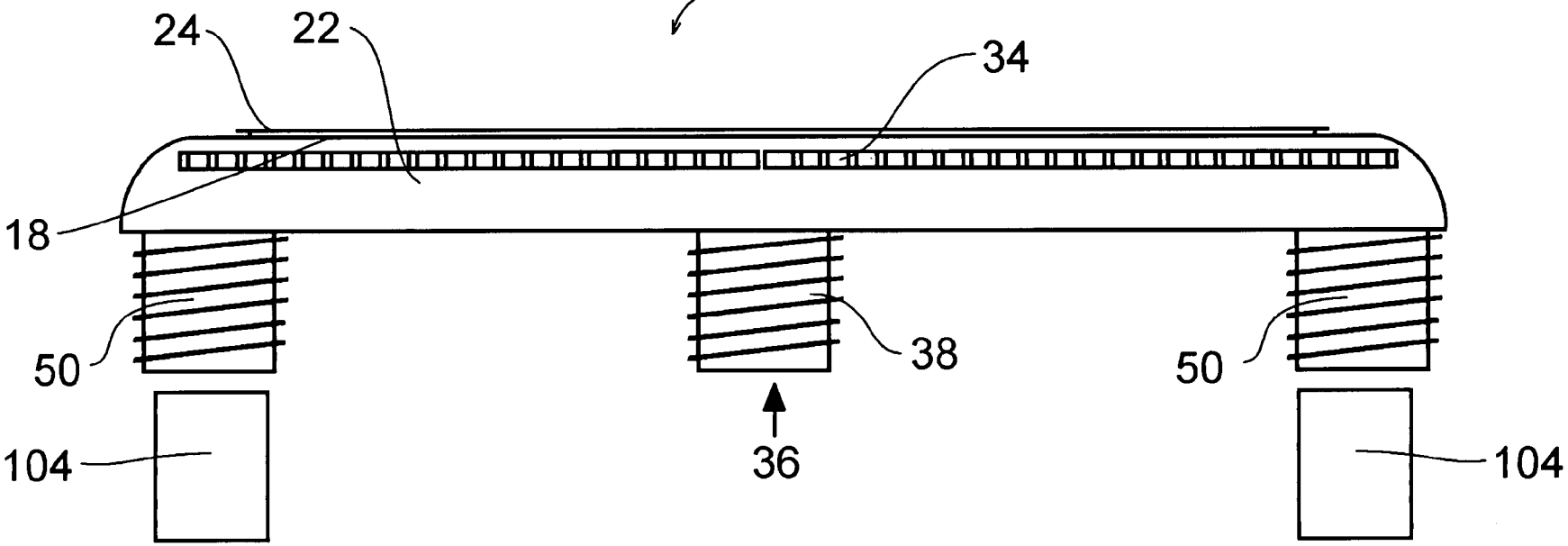
FIG. 9 is a top view of the invention including an optional light source to produce an illuminated waterfall.

Illustrative embodiments of a waterfall waterjet 16 according to the present invention are shown in FIGS. 1 through 7. FIG. 1 is a perspective view of one embodiment of the present invention for producing a waterfall into the water of a spa. FIG. 2 is a front view of the embodiment shown in FIG. 1. FIG. 3A is a sectional top view of the invention with the debris outlets closed. FIG. 3B is a sectional top view of the invention with the debris outlets opened. FIG. 4 is an exploded view of illustrative components of the embodiment of the invention shown in FIG. 1. FIG. 5 is an exploded side view of the invention. FIG. 6 is a sectional side view of the invention showing the inflow of water into the invention. FIG. 7 is a bottom view of the invention showing the relative placement of a slide bar for opening and closing the debris outlets. FIG. 8 is a view of an alternate method of closing the debris outlets of the present invention showing a "water gun plug". FIG. 9 illustrates an optional embodiment of the present invention showing a light source for creating an illuminated waterfall.

Referring now to FIG. 1, one illustrative embodiment of the present invention is a waterfall waterjet 16 that can provide an aesthetically pleasing and decorative waterfall 20 into a spa 10. In this embodiment, waterfall waterjet 16 can be installed on sidewall 12 of spa 10. As disclosed in more detail herein, to generate the waterfall 20, water from a water source (not shown) flows into waterfall waterjet 16 and is discharged through waterfall slot/primary outlet 18 into spa 10 where it meets the water 14 of the spa 10. The water from the source (not shown) may be a municipal water source or recirculated water 14 from the spa 10. As waterfall waterjet 16 can be placed above the surface of the water of spa 10 on, for example, the upper edge of sidewall 12 of spa 10, the waterfall waterjet 16 can function to fill spa 10 with water 14 (i.e., non-recirculating).

Referring now to FIG. 2, an illustrative front view is shown of an embodiment of waterfall waterjet 16 that preferably comprises a body cover 22 (shown elongated) and a flow/outlet selector 26. Waterfall waterjet 16 may further include a cap/cover 24, which may be manufactured separately from body cover 22 and flow/outlet selector 26. Body cover 22 is a generally hollow half-cylindrical structure. Flow/outlet selector 26 is utilized to select between two or more flow paths/outlets as further discussed below. Waterfall slot/primary outlet 18 is located lengthwise along body cover 22 and provides an exit for water to flow from the hollow interior of waterfall waterjet 16. Cap/cover 24 can be inserted into waterfall slot/primary outlet 18 to form the shape of the waterfall. This illustrative multi-component configuration is for ease of manufacturing and installation, and configurations having more or fewer components are within the scope and spirit of this invention.

Referring now to FIG. 3A, the internal structure of waterfall waterjet 16 is shown in more detail. Waterfall waterjet 16 is preferably divided into first chamber 30 and second chamber 32 by baffles/divider 34, such that only second chamber 32 has access to waterfall slot/primary outlet 18. Each chamber 30, 32 preferably runs the horizontal length of waterfall waterjet 16. First chamber 30 is for initially receiving water 36 from the water source via inlet 38 and evenly distributing water within waterfall waterjet 16. Second chamber 32 is for receiving water from first chamber 30 and channeling water through waterfall slot/primary outlet 18 to waterfall 20. It is thus preferred that water flowing into waterfall waterjet 16 first flows into first chamber 30 within which the water is generally evenly distributed, then flows through holes in baffles/divider 34 into second chamber 32, and then exits through waterfall slot/primary outlet 18 to form waterfall 20.

As shown in FIG. 3A, debris 100 may become trapped behind the baffles/divider 34 on back surface 40. In addition, it is common for sediment 102 to settle out of the water flow in regions of relatively lower fluid flow, such regions are generally designated by reference number 42 and are typically located at the lateral ends of the waterfall waterjet 16. In order to remove such debris 100 and sediment 102, waterfall waterjet 16 is preferably configured with one or more debris outlets 44 (shown in dashed lines) at or proximal to these locations. It is within the scope of the invention to configure any number of such debris outlets 44 as desired and to further include a system for a user to open and close debris outlets 44.

A representative system for allowing a user to open and close debris outlets 44 is shown in FIG. 3A, in which bar 46 may extend between the one or more debris outlets 44 and flow/outlet selector 26 (see FIG. 7). Bar 46 includes holes 48 which correspond to the location of debris outlets 44. In the "normal" operating mode illustrated in FIG. 3A, holes 48 of bar 46 do not align with debris outlets 44. In this instance, very little to no flow could occur through debris outlets 44; almost all to all of the water flow out of waterfall waterjet 16 would have to occur through waterfall slot/primary outlet 18 (shown in FIGS. 1 and 2).

FIG. 3B illustrates the waterfall waterjet 16 when debris outlets 44 have been opened by way of sliding bar 46 via flow/outlet selector 26 (see FIG. 7). This may be termed the "debris removing" operation. In this position, holes 48 align with debris outlets 44 creating an opening between first chamber 30 and the outside. As discussed in more detail below, this opening allows water, and any debris 100 and/or sediment 102 carried by water to flow out of the waterfall waterjet 16 without passing through baffles/divider 34 or waterfall slot/primary outlet 18.

Referring now to FIG. 4, preferred components of waterfall waterjet 16 are shown in more detail, including flow/outlet selector 26, base 54, bar 46, body cover 22, and cap/cover 24. A representative procedure for installing waterfall waterjet 16 onto spa sidewall 12 could involve inserting cap/cover 24 into waterfall slot/primary outlet 18 on body cover 22 (see FIG. 2); inserting bar 46 into first chamber 30 of base 54 (shown in FIGS. 5 and 6) such that a bar first surface 58 of bar 46 fits against a cradle interior bottom surface of base 54 (shown in FIGS. 5 and 6); placing body cover 22 over the cradle on base 54 (more particularly, a cavity 56 on the back side of body cover 22 is mated to the cradle of base 43 as shown in FIGS. 5 and 6); and attaching flow/outlet selector 26 to bar 46 such that selector first surface 66 can be inserted through an access port 68 in base 54 and attached to bar 46 at, for instance, attachment point 70 (shown in dashed lines). In this assembled condition, body cover holes 62 (through body cover wall 64) should be in alignment with debris outlets 44 of base 54 (as shown in FIGS. 3A and 3B). Further, selector bottom surface 72 of flow/outlet selector 26 may either be contiguous with, or on top of base bottom surface 74 in order to present an aesthetically pleasing appearance to waterfall waterjet 16.

Referring now to FIG. 5, an exploded cross-sectional side view of an illustrative embodiment of waterfall waterjet 16 is shown in more detail, with base 54, bar 46, baffles/divider 34, body cover 22, and cap/cover 24 being used as the example. Base 54 is a generally hollow conduit comprising inlet 38 through which water can flow. Preferred aspects of base 54 include inlet 38, cradle 76 and base bottom flange surface 79. Bar 46 may be inserted into cradle 76 such that bar first surface 58 is in contact with cradle interior bottom surface 84. Cradle 76 also receives baffles/divider 34. Cradle 76 can mate with cavity 56 of body cover 22 such that cradle exterior top surface 78 mates with body cover cavity interior top surface 80 and cradle interior bottom surface 82 mates with cavity interior bottom surface 60. Selector first surface 66 of flow/outlet selector 26 is inserted through access port 68 in base 54 such that selector first surface 66 preferably comes into fixed relation with bar first surface 58 so that when the flow/outlet selector 26 is moved, debris outlets 44 are opened or closed. Finally cap/cover 24 may be inserted into a corresponding opening in body cover 22, such as waterfall slot/primary outlet 18.

Referring now to FIG. 6, the assembled waterfall waterjet 16 is shown in more detail. Water 36 first flows into inlet 38 and then into first chamber 30. The water then flows around or through baffles/divider 34. Baffles/divider 34 may be configured with any number of holes 35 and slats to allow for a more smooth and even distribution of water within waterfall waterjet 16 in general and into second chamber 32 more specifically, and to reduce turbulence, and thus to waterfall slot/primary outlet 18. Because of the nature of water flow, second chamber 32 will readily fill with water. To help evenly distribute water within second chamber 32, a series of perforations can be used on baffles/divider 34 rather than a single distributing slot so as to interrupt the flow of water from first chamber 30 to second chamber 32, thus causing water to fill first chamber 30 relatively evenly, with the water then being forced through baffles/divider 34 into second chamber 32. By allowing for the more even distribution of water from first chamber 30 to second chamber 32, waterfall waterjet 16 can distribute water through waterfall slot/primary outlet 18 more effectively. As such, it is possible to generate a more even flow to second chamber 32 and thus a more even waterfall 20 from waterfall waterjet 16. Representative heights of such openings in baffles/divider 34 are designated by H1 and H2 and they may be set to adjust the volume of water flow into the second chamber 32, or to control the exit velocity of the water out of the waterfall waterjet 16.

FIG. 6 also illustrates the fit between cradle 76 and cavity 56. Debris outlet channel 86 also is designated in this illustration and it is the channel through which water, sediment and debris flows when the waterfall waterjet 16 is in the "debris removing" operation. Though not shown in this figure, it is understood that base 54 is attached to spa sidewall 12 through a pre-existing hole in spa sidewall 12 using the attachment means discussed above.

Referring now to FIG. 7, a bottom view of waterfall waterjet 16 is shown. Access port 70 has a first end 88 and a second end 90. In "normal" operation, flow/outlet selector 26 is situated at the first end 88 of access port 70 and there is little to no flow through debris outlets 44. Specifically, portions of bar 46 cover debris outlets 44, preferably in a watertight fashion. In the "debris removing" operation, flow/outlet selector 26 may be situated at the second end 90 (by sliding, for example) of access port 70 and debris outlets 44 are opened permitting water and debris to flow through. Specifically, by sliding flow/outlet selector 26 from first end 88 to second end 90, bar 46, which is attached to flow/outlet selector 26, is moved such that holes 48 align with debris outlets 44. As a result, water is not forced through baffles/divider 34, but may "wash" across the back (upstream) side 40 of baffles/divider 34 and dislodge debris 100. Dislodge debris 100 and sediment 102 then may flow with water through debris outlets 44.

FIG. 8 illustrates an alternate system for closing off the debris outlets 44 consisting of a stopper mechanism 92. Stopper mechanism 92 may include a conical section 94, connection means 96 and an anchor means 98. This system can be utilized by inserting anchor means 98 into the debris outlet 44 and pushing the conical section 94 into the debris outlet 44 to close it off. When it becomes necessary to remove debris 100 and/or sediment 102 from waterfall waterjet 16, a user simply pulls the conical section 94 out of debris outlet 44 and water and debris 100 and/or sediment 102 are then able to flow out of the waterfall waterjet 16.

Other mechanisms can be used to open and close debris outlet 44. For example, variable apertures, rotating dials, pivoting bars or levers, and the like all can be configured proximal to debris outlets 44. Each of these alternative means, as well as others, are known in the art, and it is contemplated that each of these alternative means, as well as others, can be used as the means for opening and closing debris outlet.

In operation and use, waterfall waterjet 16 provides an aesthetically pleasant waterfall 20 into a spa 10. As waterfall waterjet 16 preferably is located above the water surface of spa 10 on, for example, sidewall 12 of spa 10, waterfall 20 can provide a smooth flow of falling water extending from waterfall waterjet 16 to the water surface of spa 10. For aesthetic reasons waterfall 20 can be substantially smooth over its width and over its length as it flows into the water of spa 10. More particularly, waterfall 20 from waterfall waterjet 16 preferably is free of bubbles and ripples and flows as a generally continuous sheet of water. The preferred dual chambered structure of the waterfall waterjet 16 helps accomplish this.

Waterfall waterjet 16 is attached to spa sidewall 12 via inlet 38 and one or more attachment means, such as threaded connecting posts 50, which fit through cooperating and similarly sized holes in spa sidewall 12 and have respective nuts/fasteners 52, 52A that screw onto posts 50 and inlet 38, respectively. so as to hold waterfall waterjet 16 securely and tightly onto spa sidewall 12. A hose or other water supply means (not shown) also can be attached to inlet 38 for providing water to waterfall waterjet 16. Posts 50 can be any size or shape and am shown alternatively as a small diameter tube in FIG. 7 and a larger diameter tube in FIG. 9. Posts 50 also can be a simple bolt or rod or a type of clip, depending on the type of installation or the desire of the installer.

Preferably, connections between base 54, bar 46, body cover 22, and cap/cover 24 are as watertight as possible. If the connections between the various components of waterfall waterjet 16 are not watertight, water may escape though the connections. In some cases, it may be optimal to use fillers, sealants, o-rings or the equivalent to help ensure watertight connection between the parts of waterfall waterjet 16, particularly between bar first surface 58 and cradle interior bottom surface 84. Methods for ensuring a watertight connection between parts or plumbing parts are known by one of ordinary skill in the art. Further, the various components of waterfall waterjet 16 may be attached by any appropriate means, including gluing and sonic welding.

As waterfall waterjets typically are unitary devices with the individual parts having been glued, welded or otherwise adhered together, access to the interior of the waterfall waterjet often is impossible. Therefore, the debris outlets 44 of the present invention allow for the cleaning of waterfall waterjets that otherwise may not have been able to be cleaned. Prior art waterfall waterjets can become clogged with debris 100 and/or sediment 102 and, if a unitary device without debris outlets 44 or a non-unitary device (that is, a device with component parts that can be separated form each other) with inadequate access to the interior of the device becomes clogged with debris 100 and/or sediment 102, such a device likely would have to be removed from the spa, discarded and replaced with another device. This is avoided by the present invention.

It is understood that shape of waterfall 20 can be modified by the configuration of waterfall slot/primary outlet 18. For example, if waterfall slot/primary outlet 18 is a regular uninterrupted slit, a relatively smooth waterfall 20 over its length and width can be generated. Alternatively, if divisions or interruptions are introduced into the waterfall slot/primary outlet 18, or waterfall slot/primary outlet 18 has a non-linear shape, waterfall 20 can have a sprinkler type shape or a scalloped shape, which is not a smooth shaped waterfall. One of ordinary skill in the art can modify waterfall slot/primary outlet 18 so that waterfall waterjet 16 will produce a waterfall 20 of a desired shape. Cap/cover 24 generally is provided to shape the waterfall 20 into any of a variety of shapes, such as for example a single sheet-like waterfall, a split waterfall, or a multi-stream waterfall. Cap/cover 24 generally is glued, welded, or otherwise adhered to body cover 22 to avoid inadvertent removal, such as by falling off or by being ejected by water pressure, and inadvertent noise, such as by rattling caused by water pressure. Alternatively, cap/cover 24 can be removable so as to provide a waterfall waterjet 16 with interchangeable waterfalls 20.

FIG. 9 illustrates an alternate embodiment of the present invention in which one or more illumination devices 104 may be inserted into the one or more posts 50 of waterfall waterjet 16 to generate an illuminated waterfall 20. In order to accommodate illumination devices 104, posts 50 can be configured in any appropriate size, shape, number, and location. In addition, one or more waterfall waterjet 16 components are preferably constructed of a transparent material so that light emitted from illumination devices 104 may be more effectively transmitted to waterfall 20. In particular, it is preferred that at least cap/cover 24 and/or baffles/divider 34 is constructed of a transparent material in order to increase the amount of light transmitted to waterfall 20 and/or through waterfall slot/primary outlet 18. The internal surfaces of waterfall waterjet 16 can be coated with a reflective material to increase the amount of light directed to waterfall 20. Further, waterproof light sources, such as, for example, sealed diodes, can be incorporated into waterfall waterjet 16 structure or extend into the interior of waterfall waterjet 16.

In a further preferred embodiment, baffles/divider 34 may include, or be comprised of, a light emitting device to more effectively transmit light to the water stream at a point close to waterfall slot/primary outlet 18 in order to provide increased transmission of light to the waterfall 20. It is also acceptable if receiving water 36 is situated at a proximal end of waterfall waterjet 16, such as through posts 50, and an illumination device 104 is positioned more centrally, such as at inlet 38. For example, one or more of posts 50 could serve as the water inlet while inlet 38 could serve as an attachment post.

Waterfall waterjet 16 can be manufactured from relatively inexpensive materials. For example, waterfall waterjet 16 can be formed of plastics, metal, or other materials. Preferably, waterfall waterjet 16 can be molded or forged from a plastic material as such material will not rust from the exposure to water, particularly chlorinated water. Such plastics, metals, and other materials are known in the art. Alternatively, for more elegant or expensive installations, waterfall waterjet can be made of more elegant or expensive materials, such as gold, silver, pewter, crystal, and the like.

The foregoing detailed description of the preferred embodiments and the appended figures have been presented only for illustrative and descriptive purposes and are not intended to be exhaustive or to limit the scope and spirit of the invention. The embodiments were selected and described to best explain the principles of the invention and its practical applications. One of ordinary skill in the art will recognize that many variations can be made to the invention disclosed in this specification without departing from the scope and spirit of the invention.

What is claimed is:

1. A device for producing an artificial waterfall comprising:

a) a waterfall waterjet including at least one chamber;

b) at least one inlet for water into the waterfall waterjet;

c) at least one primary outlet having an opening to pass water out of the waterfall waterjet;

d) at least one debris outlet having at least one opening to pass water and debris out of the waterfall waterjet; and e) a means of opening and closing the debris outlet.

2. The device as claimed in claim 1, wherein the means of opening and closing the at least one debris outlet is movable back and forth from a first closed position wherein water and debris are prevented from passing out of the at least one debris outlet to a second open position wherein water and debris are allowed to pass out of the at least one debris outlet.

3. The device as claimed in claim 2, wherein the means of opening and closing the at least one debris outlet is selected from the group consisting of sliding bars and stoppers.

4. The device as claimed in claim 3, wherein there are two debris outlets.

5. The device as claimed in claim 3, wherein the means of opening and closing the at least one debris outlet is a sliding bar.

6. The device as claimed in claim 4, wherein the means of opening and closing the two debris outlets is a single sliding bar that is movable back and forth from a first closed position wherein water and debris are prevented from passing out of the two debris outlets to a second open position wherein water and debris are allowed to pass out of the two debris outlets.

7. The device as claimed in claim 1, wherein one or more baffles are positioned in the chamber dividing the chamber into a first chamber and a second chamber.

8. The device as claimed in claim 7, wherein the first chamber transiently collects the water and transfers the water through the baffles positioned in the chamber to the second chamber, and the second chamber channels the water to and through the primary outlet.

9. The device as claimed in claim 1, further including a means of illuminating the waterfall.

10. The device as claimed in claim 1, further including a supporting structure.

11. The device as claimed in claim 10, wherein the supporting structure is selected from the group consisting of spas, swimming pools, tubs and showers, and water is fed into the device from a water filtering system used with the supporting structure.

12. A device for producing an artificial waterfall in an artificial water structure, comprising:

a) a waterfall waterjet comprising a first chamber, a second chamber, a water inlet into the first chamber, a distribution slot fluidly connecting the first chamber to the second chamber, a divider separating the first chamber and the second chamber from each other, at least one primary outlet, at least one debris outlet separate from the primary outlet, and a means for opening and the at least one debris outlet;

b) a water source fluidly connected to the waterfall waterjet for allowing water to flow from the water source through the water inlet into the waterfall waterjet; and c) means for fastening the waterfall waterjet to the water structure.

13. The device as claimed in claim 12, wherein the means of opening and closing the at least one debris outlet is movable back and forth from a first closed position wherein water and debris are prevented from passing out of the at least one debris outlet to a second open position wherein water and debris are allowed to pass out of the at least one debris outlet.

14. The device as claimed in claim 13, wherein the means of opening and closing the at least one debris outlet is selected from the group consisting of sliding bars and stoppers.

15. The device as claimed in claim 14, wherein there are two debris outlets.

16. The device as claimed in claim 14, wherein the means of opening and closing the at least one debris outlet is a sliding bar.

17. The device as claimed in claim 15, wherein the means of opening and closing the two debris outlets is a single sliding bar that is movable back and forth from a first closed position wherein water and debris are prevented from passing out of the two debris outlets to a second open position wherein water and debris are allowed to pass out of the two debris outlets.

18. The device as claimed in claim 12, wherein the divider and the distribution slot cooperate whereby passage of the water from the first chamber to the second chamber through the divider more evenly distributes the water within the waterfall waterjet so as to create a more uniform waterfall.

19. The device as claimed in claim 12, wherein the primary outlet extends lengthwise across the majority of a length of the waterfall waterjet.

20. The device as claimed in claim 12, wherein the water entering the waterfall waterjet exits primarily out of the primary outlet when the debris outlet is closed.

21. The device as claimed in claim 12, wherein the first chamber transiently collects the water and transfers the water through the distribution slot to the second chamber, and the second chamber channels the water to and through the primary outlet.

22. The device as claimed in claim 12, further comprising a plurality of distribution slots through the divider.

23. The device as claimed in claim 12, further including a means of illuminating the waterfall.

24. A device for producing an artificial waterfall in an artificial water structure, comprising:

a) a waterfall waterjet comprising a first chamber, a second chamber, a water inlet into the first chamber, a distribution slot fluidly connecting the first chamber to the second chamber, a divider separating the first chamber and the second chamber from each other, at least one primary outlet and at least one debris outlet separate from the primary outlet;

b) a water source fluidly connected to the waterfall waterjet for allowing water to flow from the water source through the water inlet into the waterfall waterjet; and c) means for fastening the waterfall waterjet to the water structure, wherein the means of opening and closing the at least one debris outlet is movable back and forth from a first closed position wherein water and debris are prevented from passing out of the at least one debris outlet to a second open position wherein water and debris are allowed to pass out of the at least one debris outlet.

25. The device as claimed in claim 24, wherein the means of opening and closing the at least one debris outlet is selected from the group consisting of sliding bars and stoppers.

26. The device as claimed in claim 24, wherein the means of opening and closing the at least one debris outlet is a sliding bar.

27. The device as claimed in claim 24, wherein there are two debris outlets and the means of opening and closing the two debris outlets is a single sliding bar that is movable back and forth from a first closed position wherein water and debris are prevented from passing out of the two debris outlets to a second open position wherein water and debris are allowed to pass out of the two debris outlets.

28. The device as claimed in claim 24, further including a means of illuminating the waterfall.

29. A device for producing an artificial waterfall in an artificial water structure, comprising:

a) a waterfall waterjet comprising a first chamber, a second chamber, a water inlet into the first chamber, a distribution slot fluidly connecting the first chamber to the second chamber, a divider separating the first chamber and the second chamber from each other, at least one primary outlet and at least one debris outlet separate from the primary outlet;

b) a water source fluidly connected to the waterfall waterjet for allowing water to flow from the water source through the water inlet into the waterfall waterjet; and c) means for fastening the waterfall waterjet to the water structure, wherein the means of opening and closing the at least one debris outlet is a sliding bar movable back and forth from a first closed position wherein water and debris are prevented from passing out of the at least one debris outlet to a second open position wherein water and debris are allowed to pass out of the at least one debris outlet.

30. The device as claimed in claim 29, wherein there are two debris outlets and the means of opening and closing the two debris outlets is a single sliding bar that is movable back and forth from a first closed position wherein water and debris are prevented from passing out of the two debris outlets to a second open position wherein water and debris are allowed to pass out of the two debris outlets.

31. The device as claimed in claim 29, further including a means of illuminating the waterfall.

32. In a device for producing a waterfall into an artificial body of water, the device comprising a water inlet into an interior chamber and a waterfall producing outlet from the interior chamber, the improvement comprising at least one debris outlet separate from the waterfall producing outlet and having at least one opening to pass water and debris out of the waterfall waterjet.

33. The device as claimed in claim 32, further comprising a means of opening and closing the at least one debris outlet.

34. The device as claimed in claim 33, wherein the means of opening and closing the at least one debris outlet is movable back and forth from a first closed position wherein water and debris are prevented from passing out of the at least one debris outlet to a second open position wherein water and debris are allowed to pass out of the at least one debris outlet.

35. The device as claimed in claim 34, wherein the means of opening and closing the at least one debris outlet is selected from the group consisting of sliding bars and stoppers.

36. The device as claimed in claim 35, wherein there are two debris outlets.

37. The device as claimed in claim 35, wherein the means of opening and closing the at least one debris outlet is a sliding bar.

38. The device as claimed in claim 36, wherein the means of opening and closing the two debris outlets is a single sliding bar that is movable back and forth from a first closed position wherein water and debris are prevented from passing out of the two debris outlets to a second open position wherein water and debris are allowed to pass out of the two debris outlets.

39. The device as claimed in claim 32, further including a means of illuminating the waterfall.

40. In a device for producing a waterfall into an artificial body of water, the device comprising a water inlet into an interior chamber and a waterfall producing outlet from the interior chamber, the improvement comprising:

a) at least one debris outlet separate from the waterfall producing outlet and having at least one opening to pass water and debris out of the waterfall waterjet; and b) a means of opening and closing the at least one debris outlet.

41. The device as claimed in claim 40, wherein the means of opening and closing the at least one debris outlet is movable back and forth from a first closed position wherein water and debris are prevented from passing out of the at least one debris outlet to a second open position wherein water and debris are allowed to pass out of the at least one debris outlet.

42. The device as claimed in claim 41, wherein the means of opening and closing the at least one debris outlet is selected from the group consisting of sliding bars and stoppers.

43. The device as claimed in claim 42, wherein there are two debris outlets.

44. The device as claimed in claim 41, wherein the means of opening and closing the at least one debris outlet is a sliding bar.

45. The device as claimed in claim 43, wherein the means of opening and closing the two debris outlets is a single sliding bar that is movable back and forth from a first closed position wherein water and debris are prevented from passing out of the two debris outlets to a second open position wherein water and debris are allowed to pass out of the two debris outlets.

46. The device as claimed in claim 40, further including a means of illuminating the waterfall.

47. In a device for producing a waterfall into an artificial body of water, the device comprising a water inlet into an interior chamber and a waterfall producing outlet from the interior chamber, the improvement comprising:

a) at least one debris outlet separate from the waterfall producing outlet and having at least one opening to pass water and debris out of the waterfall waterjet; and b) a means of opening and closing the at least one debris outlet, wherein the means of opening and closing the at least one debris outlet is movable back and forth from a first closed position wherein water and debris are prevented from passing out of the at least one debris outlet to a second open position wherein water and debris are allowed to pass out of the at least one debris outlet and is selected from the group consisting of sliding bars and stoppers.

48. The device as claimed in claim 47, wherein there are two debris outlets.

49. The device as claimed in claim 47, wherein the means of opening and closing the at least one debris outlet is a sliding bar.

50. The device as claimed in claim 48, wherein the means of opening and closing the two debris outlets is a single sliding bar that is movable back and forth from a first closed position wherein water and debris are prevented from passing out of the two debris outlets to a second open position wherein water and debris are allowed to pass out of the two debris outlets.

51. The device as claimed in claim 47, further including a means of illuminating the waterfall.

52. In a device for producing a waterfall into an artificial body of water, the device comprising a water inlet into an interior chamber and a waterfall producing outlet from the interior chamber, the improvement comprising:

a) two debris outlets separate from the waterfall producing outlet, each debris outlet having an opening to pass water and debris out of the waterfall waterjet; and b) a means of opening and closing the two debris outlets, wherein the means of opening and closing the two debris outlets is a single sliding bar that is movable back and forth from a first closed position wherein water and debris are prevented from passing out of the two debris outlets to a second open position wherein water and debris are allowed to pass out of the two debris outlets.

53. The device as claimed in claim 52, further including a means of illuminating the waterfall.

* * * * *